US006933089B2

(12) United States Patent
Horgan et al.

(10) Patent No.: US 6,933,089 B2
(45) Date of Patent: Aug. 23, 2005

(54) IMAGING MEMBER

(75) Inventors: Anthony M. Horgan, Pittsford, NY (US); Satchidanand Mishra, Webster, NY (US); Robert C. U. Yu, Webster, NY (US); Kathleen M. Carmichael, Williamson, NY (US); Kent J. Evans, Lima, NY (US); Timothy J. Fuller, Pittsford, NY (US); Colleen A. Helbig, Penfield, NY (US); John F. Yanus, Webster, NY (US); Damodar M. Pai, Fairport, NY (US); Karen S. Garland, Palmyra, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/320,808

(22) Filed: Dec. 16, 2002

(65) Prior Publication Data

US 2004/0115545 A1 Jun. 17, 2004

(51) Int. Cl.[7] ..... G03G 5/047

(52) U.S. Cl. ..... 430/58.8; 430/59.6; 430/59.4; 399/159

(58) Field of Search ..... 399/159; 430/970, 430/59.4, 58.8, 59.6, 58.05, 58.65

(56) References Cited

U.S. PATENT DOCUMENTS

| | | | | | |
|---|---|---|---|---|---|
| 4,233,384 | A | | 11/1980 | Turner et al. | 430/59 |
| 4,265,990 | A | | 5/1981 | Stolka et al. | 430/59 |
| 4,286,033 | A | | 8/1981 | Neyhart et al. | 430/58 |
| 4,291,110 | A | | 9/1981 | Lee | 430/59 |
| 4,299,897 | A | | 11/1981 | Stolka et al. | 430/59 |
| 4,306,008 | A | | 12/1981 | Pai et al. | 430/59 |
| 4,338,387 | A | | 7/1982 | Hewitt | 430/58 |
| 4,346,158 | A | | 8/1982 | Pai et al. | 430/59 |
| 4,439,507 | A | | 3/1984 | Pan et al. | 430/59 |
| 4,563,408 | A | | 1/1986 | Lin et al. | 430/59 |
| 4,599,286 | A | | 7/1986 | Limburg et al. | 430/59 |
| 4,654,284 | A | | 3/1987 | Yu et al. | 430/59 |
| 4,988,597 | A | | 1/1991 | Spiewak et al. | 430/62 |
| 5,096,793 | A | * | 3/1992 | Osawa et al. | 430/58.05 |
| 5,244,762 | A | | 9/1993 | Spiewak et al. | 430/64 |
| 5,401,615 | A | * | 3/1995 | Pai et al. | 430/58.8 |
| 5,473,064 | A | * | 12/1995 | Mayo et al. | 540/141 |
| 5,613,173 | A | | 3/1997 | Kunzmann et al. | 399/89 |
| 5,792,582 | A | * | 8/1998 | Yuh et al. | 430/970 |
| 2003/0087171 | A1 | * | 5/2003 | Tokutake et al. | 430/970 |

OTHER PUBLICATIONS

Borsenberger, Paul M. et al. Organic Photoreceptors for Imaging Systems. New York: Marcel–Dekker, Inc (1993) pp. 6–17, 190–195, 289–292, 338–345, & 349–355.*

* cited by examiner

*Primary Examiner*—Christopher Rodee
(74) *Attorney, Agent, or Firm*—Eugene O. Palazzo; Fay, Sharpe, Fagan, Minnich & McKee, LLC.

(57) ABSTRACT

A charge transport layer for an imaging member comprising a dual charge transport layer and wherein the charge transport layers comprise a photogenerating layer; (1) a first charge transport layer comprised of a charge transport component and a resin binder; and thereover and in contact with the first layer; (2) a second top charge transport layer comprised of a charge transport component, a resin binder and a hindered phenol dopant. The charge transport layer exhibits, excellent electrical performance, outstanding print quality and reduces the diffusion of the anti-oxidant into the charge generator layer.

28 Claims, No Drawings

IMAGING MEMBER

CROSS-REFERENCE TO RELATED APPLICATIONS

Attention is directed to commonly-assigned copending U.S. patent application Ser. No. 10/320,856, filed Dec. 16, 2002, by Tong, et al, and which application discloses an imaging member comprised of a photogenerating layer, (1) a first charge transport layer comprised of a charge transport component and a resin binder, and thereover and in contact with the first layer, (2) a second top charge transport layer comprised of a charge transport component and a polymer of a styrene containing a hindered phenol.

The disclosure of the above mentioned copending application is incorporated herein by reference.

The appropriate components, layers, processes, and the like of the above copending application may be selected for the present invention in embodiments thereof.

BACKGROUND

This invention relates in general to an electrostatographic imaging member comprised of two separate charge transport layers and a photogenerating layer; and more specifically, (1) a first charge transport layer comprised of a charge transport component and a resin binder; and thereover and in contact with the first layer, (2) a second top charge transport layer comprised of a charge transport component, a resin binder and a hindered phenol dopant, and wherein in embodiments the second charge transport layer is applied from a mixture of resin binder, especially a polycarbonate, like poly(4,4'-diphenyl)-1,1'-cyclohexane carbonate, PCZ, and a hindered phenol contained in a solvent which does not substantially dissolve components, especially the resin binder of the first charge transport layer, and cause undesirable migration of the hindered phenol through the first charge transport layer, and in some instances through the charge generating layer. Solvents such as, for example, tetrahydrofuran, trichloroethylene, trichloroethane, 2,4-dichlorobenzene, chloroform and the like may be used in the second charge transport layer. A number of charge transport molecules oxidize to form conductive species upon exposure to corona effluents emitted from machine charging devices. With a single charge transport layer, the undesirable oxidation products of N,N'-diphenyl-N,N'-bis(alkylphenyl)-1,1-biphenyl-4,4'-diamine reside on the imaging member surface. These charged species allow the charged image to diffuse or migrate laterally. These species may also migrate from the charge transport layer to the photogenerating layer resulting in image degradation.

Advantages associated with the imaging members of the present invention in embodiments thereof include, for example, the avoidance of the formation of conductive by-products, the undesirable migration of a hindered phenol to the photogenerating layer, thereby avoiding imaging member instability, such as, electrical performance degradation, and undesirable electrical characteristics especially on long term cycling of the member; coating of two transport layers in separate passes to, for example, minimize transport layer thickness variations, which variations can cause image defects referred to as rain drops; minimizing and in embodiments, avoiding an increase in the lateral surface conductivity of the member which in turn can cause image degradation, referred to as lateral conductivity migration (LCM); and in embodiments the elimination of charge transport component oxidation is achieved wherein selected amounts for example, from about 3 to about 20 percent by weight of a hindered phenol, tetrakis[methylene(3,5-di-tert-butyl-4-hydroxy hydrocinnamate)]methaneIRGANOX®-1010 is added to a solution containing a resin binder and a charge transport component dissolved in a solvent other than for example, a solvent that will dissolve the resin binder of the first charge transport layer such as methylene chloride.

Processes of imaging, especially xerographic imaging and printing, including digital, are also encompassed by the present invention. More specifically, the layered photoconductive imaging members of the present invention can be selected for a number of different known imaging and printing processes including, for example, electrophotographic imaging processes, especially xerographic imaging and printing processes wherein charged latent images are rendered visible with toner compositions of an appropriate charge polarity. Moreover, the imaging members of this invention are useful in color xerographic applications, particularly high-speed color copying and printing processes and which members are in embodiments, sensitive in the wavelength region of, for example, from about 500 to about 900 nanometers, and in particular from about 650 to about 850 nanometers, thus diode lasers can be selected as the light source.

REFERENCES

Electrophotographic imaging members may be multilayered photoreceptors that comprise a substrate support, an electrically conductive layer, an optional charge blocking layer, an optional adhesive layer, a charge generating layer, a charge transport layer, and an optional protective or overcoating layers. The imaging members can be of several forms, including flexible belts, rigid drums, and the like. For a number of multilayered flexible photoreceptor belts, an anticurl layer may be employed on the backside of the substrate support, opposite to the side carrying the electrically active layers, to achieve the desired photoreceptor flatness.

Various combinations of materials for the charge generating layers and charge transport layers have been disclosed. U.S. Pat. No. 4,265,990, the disclosure of which is totally incorporated herein by reference, illustrates a layered photoreceptor having a separate charge generating layer (CGL) and a separate charge transport layer (CTL). The charge generating layer is capable of photogenerating holes and injecting the photogenerated holes into the charge transport layer. The photogenerating layer utilized in multilayered photoreceptors include, for example, inorganic photoconductive particles or organic photoconductive particles dispersed in a film forming polymeric binder. Examples of photosensitive members having at least two electrically operative layers including a charge generating layer and a diamine containing transport layer are disclosed in U.S. Pat. Nos. 4,265,990, 4,233,384, 4,306,008, 4,299,897 and 4,439,507, the disclosures of each of these patents being totally incorporated herein by reference in their entirety.

In multilayer photoreceptor devices, one property, for example, is the charge carrier mobility in the transport layer. Charge carrier mobility determines the velocities at which the photo-injected carriers transit the transport layer. For greater charge carrier mobility capabilities, for example, it may be necessary to increase the concentration of the active molecule transport compounds dissolved or molecularly dispersed in the binder. Phase separation or crystallization can establish an upper limit to the concentration of the transport molecules that can be dispersed in a binder. Thus, there is desired an imaging member that exhibits excellent performance properties and minimizes lateral conductivity migration of the charge image pattern and which characteristics may be achievable by including in the member, especially the top transport layer, a resin binder and a hindered phenol dopant and wherein the hindered phenol dopant is present in an amount of from about 3 percent to about 20 percent based on the total weight of the charge transport layer.

Dual charge transport layers having the same thickness, and wherein the second (top) layer contains an antioxidant such as, for example, tetrakis[methylene(3,5-di-tert-butyl-4-hydroxy hydrocinnamate)]methane IRGANOX®-1010 dopant and a reduced amount of charge transport compound than that in the first (bottom) layer helped resolve charge transport layer cracking and minimized charge transport compound oxidative reaction issues. However, the attempted resolution, adding a hydroxyaromatic in the charge generation layer, (see U.S. Pat. No. 4,563,408) and adding a chemical stabilizer to a single charge transport layer (see U.S. Pat. No. 4,599,286) caused an increase in electrical residual potential. However, solvents like methylene chloride present in the second charge transport layer coating solution promotes IRGANOX®-1010 migration through the second charge transport layer and into the charge generating layer. Thus, what is desired is, for example, the selection for coating of the top charge transport layer a mixture of an appropriate resin binder, charge transport molecules, a hindered phenol dopant and a solvent, such as, tetrahydrofuran, which does not substantially dissolve the binder of the first charge transport layer, and wherein the resulting imaging member exhibits excellent photoelectrical performance properties, decreased lateral migration of the charge image pattern, and is substantially free of charge transport layer cracking. This is achieved in embodiments, of the present invention by replacing the poly(4,4'-isopropylidene)carbonate (MAKROLON®) used in the first charge transport layer with another film forming polymer, poly(4,4'-diphenyl)-1,1'-cyclohexane carbonate, available from Mitsubishi Chemicals, and which dissolves readily in solvents other than methylene chloride to form a second charge transport layer coating solution wherein the second transport layer comprises the charge transport component, the polymer binder, and the dopant tetrakis [methylene(3,5-di-tert-butyl-4-hydroxy hydrocinnamate)] methane, IRGANOX®-1010, or 2,6-di-tert-butyl-4-methylphenol.

SUMMARY

Aspects of the present invention include an electrophotographic imaging member comprising a photogenerating layer;

(1) a first charge transport layer comprised of a charge transport component and a resin binder; and thereover and in contact with the first layer, and (2) a second top charge transport layer comprised of a charge transport component, a resin binder and a hindered phenol dopant and wherein there is selected for the coating solution for depositing the second layer a solvent that will not substantially dissolve the charge transport binder of the first layer;

a second or top charge transport material which minimizes the formation of oxidation products, minimizes lateral conductivity migration of the charge image pattern, and which layer contains a hindered phenol dopant in the second charge transport layer which minimizes lateral migration of the hindered phenol, including the migration minimization of the anti-oxidant tetrakis [methylene(3,5-di-tert-butyl-4-hydroxy hydrocinnamate)]methane IRGANOX®-1010 or 2,6-di-tert-butyl-4-methylphenol (BHT) in the second charge transport layer to the first charge transport layer and into the charge generator layer, a polymer binder dissolved in a solvent that does not dissolve the binder of the first charge transport layer and wherein the polymer is, for example, poly(4,4'-diphenyl)-1,1'-cyclohexane carbonate or polystyrene and wherein the hindered phenol dopant is dissolved or molecularly dispersed in a solvent other than, for example, methylene chloride, and wherein there is achieved an imaging member which minimizes the charge image surface migration pattern.

A charge transport layer with a binder, for example, polycarbonate of poly(4,4'-diphenyl)-1,1'-cyclohexane carbonate, allows the second transport layer coating solution to be prepared using toluene, tetrahydrofuran, and the like, or mixtures thereof. This is effective in preventing dissolution of the first charge transport layer binder during the coating solution application and inhibits IRGANOX®-1010 or butylated hydroxytoluene (BHT) migration into the charge generating layer.

The dual charge transport layer thus includes a first charge transport layer with a charge transport component and a resin binder and a second charge transport layer with a charge transport component, a resin binder and a hindered phenol dopant. For example, in embodiments, the second charge transport layer comprises a hole transport molecule, a resin binder and a hindered phenol dopant dispersed in a solvent. In specific embodiments, the hindered phenol comprises tetrakis [methylene(3,5-di-tert-butyl-4-hydroxy hydrocinnamate)]methane IRGANOX®-1010, available from Ciba Specialty Chemicals. In embodiments, each charge transport layer comprises, for example, from about 20 to about 80 percent by weight of at least one charge transport component and about 80 to about 20 percent by weight of a polymer binder. Each dried charge transport layer can contain from about 30 percent and about 70 percent by weight of a charge transport molecule based on the total weight of the dried charge transport layer.

The charge transport layer solution may be applied in two passes wherein two passes refers to first depositing the first transport layer on the photogenerating layer and then subsequently depositing the second charge transport layer on the first charge transport layer. In embodiments, the first charge transport layer may comprise any suitable arylamine hole transporter. An arylamine charge hole transporter molecule may be represented by:

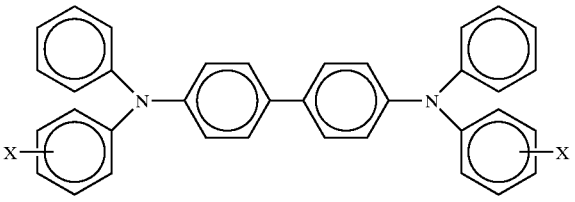

wherein X is selected from the group consisting of alkyl and halogen. Typically, the halogen is a chloride. The alkyl typically contains from 1 to about 10 carbon atoms, and in embodiments, from 1 to about 5 carbon atoms. Typical aryl amines include, for example, N,N'-diphenyl-N,N'-bis (alkylphenyl)-1,1-biphenyl-4,4'-diamine wherein alkyl is selected from the group consisting of methyl, ethyl, propyl, butyl, hexyl, and the like; and N,N'-diphenyl-N,N'-bis (halophenyl)-1,1'-biphenyl-4,4'-diamine wherein the halo substituent is preferably a chloro substituent. Other specific examples of aryl amines include, N,N'-bis(3,4-dimethylphenyl)-N"(1-biphenyl)amine, 2-bis((4'-methylphenyl)amino-p-phenyl) 1,1-diphenyl ethylene, 1-bisphenyl-diphenylamino-1-propene, and the like.

In embodiments, the first charge transport layer is formed upon a charge generating layer wherein N,N'-diphenyl-N, N'-bis(3-methylphenyl)-[1,1'-biphenyl]-4,4'diamine and a polymer binder, for example, poly(4,4'-isopropylidene) carbonate (MAKROLON®); soluble only in methylene chloride are applied.

In the application of the second charge transport layer, a charge transport component, a resin binder, and a hindered phenol dopant dissolved in a solvent other than methylene chloride are deposited to complete the dual charge transport layer. Any suitable and conventional techniques may be utilized to apply the charge transport layer coating solution to the photoreceptor structure. Typical application techniques include, for example, spraying, dip coating, extrusion coating, roll coating, wire wound rod coating, draw bar coating, and the like.

The dried charge transport layer has in embodiments, a thickness of from about 5 to about 100 micrometers and more specifically has a thickness of, for example, from about 10 micrometers to about 50 micrometers. In general, the ratio of the thickness of the charge transport layer to the charge generating layer is, in embodiments, maintained from about 2:1 to about 200:1, and in some instances about 400:1 and which charge transport layer possesses excellent wear resistance.

The charge generating layer, and charge transport layers, may be applied in any suitable order as illustrated herein to produce either positive or negative charging photoreceptors. For example, the charge generating layer may be applied prior to the charge transport layer, as illustrated in U.S. Pat. No. 4,265,990, or the charge transport layer may be applied prior to the charge generating layer, as illustrated in U.S. Pat. No. 4,346,158, the entire disclosures of these patents being incorporated herein by reference. In embodiments, however, the dual charge transport layer is employed upon a charge generating layer, and the charge transport layer may optionally be overcoated with an overcoat and/or protective layer.

The photoreceptor of the present invention may be charged using any conventional charging apparatus, which may include, for example, an AC bias charging roll (BCR), see, for example, U.S. Pat. No. 5,613,173, incorporated herein by reference in its entirety. Charging may also be effected by other known methods, for example, utilizing a corotron, dicorotron, scorotron, pin charging device, and the like.

The photoreceptor substrate may be opaque or substantially transparent, and may comprise any suitable organic or inorganic material having the requisite mechanical properties. The substrate can be formulated entirely of an electrically conductive material, or it can be an insulating material including inorganic or organic polymeric materials, such as MYLAR®, a commercially available polymer, MYLAR® coated titanium, a layer of an organic or inorganic material having a semiconductive surface layer, such as, indium tin oxide, aluminum, titanium, and the like, or exclusively be made up of a conductive material such as, aluminum, chromium, nickel, brass, and the like. The substrate may be flexible, seamless or rigid, and may have a number of many different configurations, such as, for example, a plate, a drum, a scroll, an endless flexible belt, and the like. In one embodiment, the substrate is in the form of a seamless flexible belt. The back of the substrate, particularly when the substrate is a flexible organic polymeric material, may optionally be coated with a conventional anticurl layer having an electrically conductive surface. The thickness of the substrate layer depends on numerous factors, including mechanical performance and economic considerations. The thickness of this layer may range from about 25 micrometers to about 1,000 micrometers, and in embodiments, from about 50 micrometers to about 500 micrometers for optimum flexibility and minimum induced surface bending stress when cycled around small diameter rollers, for example, 19 millimeter diameter rollers. The surface of the substrate layer is in embodiments cleaned prior to coating to promote greater adhesion of the deposited coating composition. Cleaning may be effected by, for example, exposing the surface of the substrate layer to plasma discharge, ion bombardment, and the like methods. Similarly, the substrate can be either rigid or flexible. In embodiments, the thickness of this layer is from about 3 millimeters to about 10 millimeters. For flexible belt imaging members, for example, substrate thicknesses are from about 65 to about 150 microns and, in embodiments, from about 75 to about 100 microns for optimum flexibility and minimum stretch when cycled around small diameter rollers of, for example, 19 millimeter diameter. The entire substrate can comprise the same material as that in the electrically conductive surface or the electrically conductive surface can-be merely a coating on the substrate. Any suitable electrically conductive material can be employed. Typical electrically conductive materials include copper, brass, nickel, zinc, chromium, stainless steel, conductive plastics and rubbers, aluminum, semi-transparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like.

The conductive layer of the substrate can vary in thickness over substantially wide ranges depending on the desired use of the electrophotoconductive member. Generally, the conductive layer ranges in thickness from about 50 Angstroms to many centimeters, although the thickness can be outside of this range. When a flexible electrophotographic imaging member is desired, the thickness of the conductive layer typically is from about 20 Angstroms to about 750 Angstroms, and in embodiments, from about 100 to about 200 Angstroms for an optimum combination of electrical conductivity, flexibility and light transmission.

A hole blocking layer may then optionally be applied to the substrate. Generally, electron blocking layers for positively charged photoreceptors allow the photogenerated holes in the charge generating layer at the surface of the photoreceptor to migrate toward the charge (hole) transport layer below and reach the bottom conductive layer during the electrophotographic imaging processes. A hole blocking layer may comprise any suitable material. The blocking layer may include polymers such as, polyvinylbutyral, epoxy resins, polyesters, polysiloxanes, polyamides, polyurethanes, and the like, or may be nitrogen containing siloxanes or nitrogen containing titanium compounds such as, trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl)

titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino) titanate, titanium-4-amino benzene sulfonate oxyacetate, titanium 4-aminobenzoate isostearate oxyacetate, $[H_2N(CH_2)_4]CH_3Si(OCH_3)_2$, gamma-aminobutyl) methyl diethoxysilane, and $[H_2N(CH_2)_3]CH_3Si(OCH_3)_2$, (gamma-aminopropyl)-methyl diethoxysilane, as disclosed in U.S. Pat. Nos. 4,338,387, 4,286,033 and 4,291,110. Other suitable charge blocking layer polymer compositions are also described in U.S. Pat. No. 5,244,762. These include vinyl hydroxyl ester and vinyl hydroxy amide polymers wherein the hydroxyl groups have been partially modified to benzoate and acetate esters that modified polymers are then blended with other unmodified vinyl hydroxy ester and amide unmodified polymers. An example of such a blend is a 30 mole percent benzoate ester of poly(2-hydroxyethyl methacrylate) blended with the parent polymer poly(2-hydroxyethyl methacrylate). Still other suitable charge blocking layer polymer compositions are described in U.S. Pat. No. 4,988,597. An example of such an alkyl acrylamidoglycolate alkyl ether containing polymer is the copolymer poly(methyl acrylamidoglycolate methyl ether-co-2-hydroxyethyl methacrylate). The disclosures of the U.S. Patents are incorporated herein by reference in their entirety.

The blocking layer may be applied by any suitable conventional technique such as, spraying, dip coating, draw bar coating, gravure coating, silk screening, air knife coating, reverse roll coating, vacuum deposition, chemical treatment, and the like. For convenience in obtaining thin layers, the blocking layer is, in embodiments, applied in the form of a dilute solution, with the solvent being removed after deposition of the coating by conventional techniques such as by vacuum, heating, and the like. Generally, a weight ratio of blocking layer material and solvent of between about 0.05:100 to about 5:100 is satisfactory for spray coating. The blocking layer may have a thickness of from about 0.5 to about 4 micrometers.

If desired, an optional adhesive layer may be formed on the substrate. Any suitable solvent may be used to form an adhesive layer coating solution. Typical solvents include tetrahydrofuran, toluene, hexane, cyclohexane, cyclohexanone, methylene chloride, 1,1,2-trichloroethane, monochlorobenzene, and the like, and mixtures thereof. Any suitable technique may be utilized to apply the adhesive layer coating. Typical coating techniques include extrusion coating, gravure coating, spray coating, wire wound bar coating, and the like. The adhesive layer is applied directly to the blocking layer. Thus, the adhesive layer is in embodiments, in direct contiguous contact with both the underlying charge blocking layer and the overlying charge generating layer to enhance adhesion bonding and to effect ground plane hole injection suppression. Drying of the deposited coating may be effected by any suitable conventional process such as, oven drying, infrared radiation drying, air drying, and the like. The adhesive layer should be continuous. Satisfactory results are achieved when the adhesive layer has a thickness of from about 0.01 micrometers to about 2 micrometers after drying. In embodiments, the dried thickness is from about 0.03 micrometers to about 1 micrometer. Typical adhesive layers include film-forming polymers such as, polyester, dupont 49,000 resin, available from E. I. duPont de Nemours & Co., VITEL-PE100™, available from Goodyear Rubber & Tire Co., ardel polyarylatepolyvinylbutyral, polyvinylpyrrolidone, polyurethane, polymethyl methacrylate, and the like materials.

Type V hydroxygallium phthalocyanine may be prepared by hydrolyzing a gallium phthalocyanine precursor including dissolving the hydroxygallium phthalocyanine in a strong acid and then reprecipitating the resulting dissolved precursor in a basic aqueous media; removing any ionic species formed by washing with water; concentrating the resulting aqueous slurry comprising water and hydroxygallium phthalocyanine as a wet cake; removing water from the wet cake by drying; and subjecting the resulting dry pigment to mixing with a second solvent to form the Type V hydroxygallium phthalocyanine. These pigment particles in embodiments, have an average particle size of less than about 5 micrometers.

The thickness of a photogenerating layer may not be particularly critical. Layer thicknesses of from about 0.05 micrometers to about 100 micrometers may be satisfactory and in embodiments, from about 0.05 micrometers to about 10.0 micrometers thick. The photogenerating binder layer containing photoconductive compositions and/or pigments, and the resinous binder material in embodiments, ranges in thickness of from about 0.1 micrometers to about 5 micrometers, and in a specific embodiment, of from about 0.3 micrometers to about 3 micrometers for best light absorption and improved dark decay stability and mechanical properties.

When the photogenerating material is present in a binder material, the photogenerating composition or pigment may be present in the film forming polymer binder compositions in any suitable or desired amounts. For example, from about 10 percent by volume to about 90 percent by volume of the photogenerating pigment may be dispersed in from about 10 percent by volume to about 90 percent by volume of the film forming polymer binder composition, and in embodiments, from about 20 percent by volume to about 30 percent by volume of the photogenerating pigment may be dispersed in about 70 percent by volume to about 80 percent by volume of the film forming polymer binder composition. Typically, the photoconductive material is present in the photogenerating layer in an amount of from about 5 to about 80 percent by volume, and in embodiments, from about 25 to about 75 percent by volume, and the binder is present in an amount of from about 20 to about 95 percent by volume, and in embodiments from about 25 to about 75 percent by volume, although the relative amounts can be outside these ranges. The photogenerating layer thickness is related to the relative amounts of photogenerating compound and binder, with the photogenerating material often being present in amounts of from about 5 to about 100 percent by volume. Generally, it is desirable to provide this layer in a thickness sufficient to absorb about 90 percent or more of the incident radiation which is directed upon it in the imagewise or printing exposure step. The maximum thickness of this layer is dependent primarily upon factors such as mechanical considerations, the specific photogenerating compound selected, the thicknesses of the other layers, and whether a flexible photoconductive imaging member is desired. The photogenerating layer can be applied to underlying layers by any desired or suitable method. Any suitable technique may be utilized to mix and thereafter apply the photogenerating layer coating mixture. Typical application techniques include spraying, dip coating, roll coating, wire wound rod coating, and the like. Drying of the deposited coating may be effected by any suitable technique, such as, oven drying, infrared radiation drying, air drying, and the like.

Examples of suitable binders for the photogeneration layer include polycarbonates, polyesters, including polyethylene terephthalate, polyurethanes, polystyrenes, polybutadienes, polysulfones, polyarylethers, polyarylsulfones, polyethersulfones, polycarbonates, polyethylenes, polypropylenes, polymethylpentenes, polyphenylene sulfides, polyvinyl acetates, polyvinylbutyrals, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchlorides, polyvinyl alcohols, poly-N-vinylpyrrolidinones), vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and the like. These polymers may be block, random or alternating copolymers.

Specific binders for the charge generation layer include poly(4,4'-isopropylidene diphenyl) carbonate, poly(4,4'-diphenyl-1,1'-cyclohexane carbonate) polycarbonate; poly (4,4'-diphenyl-1,1'-cyclohexane carbonate-500, with a weight average molecular weight of 51,000; or poly(4,4'-diphenyl-1,1'-cyclohexane carbonate-400, with a weight average molecular weight of 40,000.

A dual charge transport layer is then applied onto the photogenerating layer. The charge transport layer not only serves to transport holes or electrons, but also protects the photoconductive layer from abrasion or chemical attack. The charge transport layer should exhibit negligible charge generation, and discharge if any, when exposed to a wavelength of light of from about 4000 to about 9000 Angstroms. The charge transport layer should trap minimal charges, holes in a negatively charged system or electrons in a positively charged system. Charge transport layer materials are well known in the art. The charge transport layer may, for example, may comprise activating compounds or charge transport molecules dissolved or molecularly dispersed in a normally, electrically inactive film forming polymer.

In embodiments, an arylamine hole transporter molecule may be represented by:

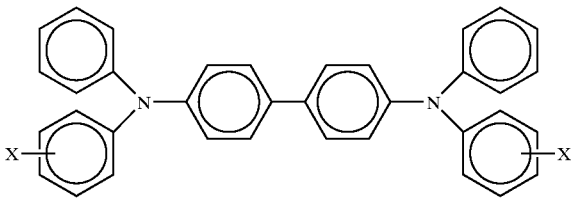

wherein X is selected from the group consisting of alkyl and halogen. Typically, the halogen is a chloride. The alkyl typically contains from 1 to about 10 carbon atoms, and in embodiments, from 1 to about 5 carbon atoms. Typical aryl amines include, for example, N,N'-diphenyl-N,N'-bis (alkylphenyl)-1,1-biphenyl-4,4'-diamine wherein alkyl is selected from the group consisting of methyl, ethyl, propyl, butyl, hexyl, and the like; and N,N'-diphenyl-N,N'-bis (halophenyl)-1,1'-biphenyl-4,4'-diamine wherein the halo substituent is preferably a chloro substituent. Other specific examples of aryl amines include, 9-9-bis(2-cyanoethyl)-2,7-bis(phenyl-m-tolylamino)fluorene, tritolylamine, N,N-bis (3,4 dimethylphenyl)-N"(1-biphenyl)amine, 2-bis((4'-methylphenyl)amino-p-phenyl) 1,1-diphenyl ethylene, 1-bisphenyl-diphenylamino-1-propene, and the like.

In one embodiment, for example, the first layer of the charge transport layer comprises N,N'-diphenyl-N,N'-bis(3-methylphenyl)-[1,1'-biphenyl]-4,4'diamine, poly(4,4'-isoproylidene diphenyl)caronate (MAKROLON®) dissolved in methylene chloride. In the second charge transport layer, N,N'-diphenyl-N,N'-bis(3-methylphenyl)-[1,1'-biphenyl]-4,4'diamine, a polystyrene binder and IRGANOX® dopant dissolved in tetrahydrofuran or toluene is deposited.

In one specific embodiment, the first charge transport layer comprises a charge transport component and poly(4,4'-isopropylidene)carbonate, MAKROLON®, and the second charge transport layer comprises a charge transport component, a charge transport component anti-oxidant dopant and poly(4,4-diphenyl)-1,1'-cyclohexane carbonate binder dissolved in a solvent other than methylene chloride.

In further embodiments, the second charge transport layer may comprise from about 3 to about 20 percent by weight of tetrakis [methylene(3,5-di-tert-butyl-4-hydroxy hydrocinnamate)]methane IRGANOX® based on the total weight of the second charge transport layer. In a specific embodiment, the second charge transport layer comprises from about 5 to about 10 weight percent of IRGANOX® based on the total weight of the second charge transport layer.

The polymer binder of the second charge transport layer may be selected from a polyphthalate carbonate represented by:

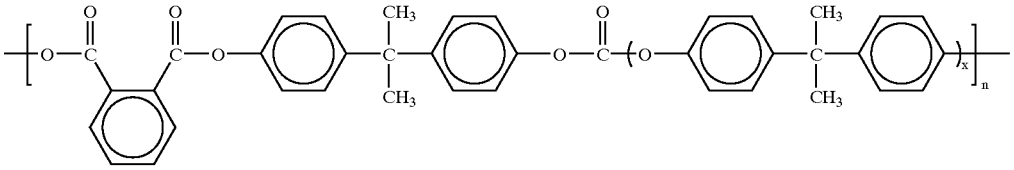

where x represents the number of segments, and n is the degree of polymerization.

Optionally, an overcoat layer and/or a protective layer can also be utilized to improve resistance of the photoreceptor to abrasion. In some cases, an anticurl back coating may be applied to the surface of the substrate opposite to that bearing the photoconductive layer to provide flatness and/or abrasion resistance where a web configuration photoreceptor is fabricated. These overcoatings and anticurl back coating layers are well known in the art, and can comprise thermoplastic organic polymers or inorganic polymers that are electrically insulating or slightly semiconductive. Overcoat layers may be continuous and typically have a thickness of less than about 10 micrometers, although the thickness can be outside this range. The thickness of anticurl backing layers is generally sufficient to balance substantially the total forces of the layer or layers on the opposite side of the substrate layer. An example of an anticurl backing layer is described in U.S. Pat. No. 4,654,284, the disclosure of which is totally incorporated herein by reference. A thickness of from about 70 to about 160 micrometers is a typical range for flexible photoreceptors, although the thickness can be outside this range. An overcoat can have a thickness of at most 3 micrometers for insulating matrices and at most 6 micrometers for semi-conductive matrices.

The photoreceptor of the invention is utilized in an electrophotographic image forming member for use in an electrophotographic imaging process. As explained above, such image formation involves first uniformly electrostatically charging the photoreceptor, then exposing the charged photoreceptor to a pattern of activating electromagnetic radiation such as light, which selectively dissipates the charge in the illuminated areas of the photoreceptor while leaving behind an electrostatic latent image in the non-illuminated areas. This electrostatic latent image may then be developed at one or more developing stations to form a visible image by depositing finely divided electroscopic toner particles, for example, from a developer composition, on the surface of the photoreceptor. The resulting visible toner image can be transferred to a suitable receiving member, such as paper. The photoreceptor is then typically cleaned at a cleaning station prior to being recharged for formation of subsequent images.

Examples of hindered phenols include; tetrakis [methylene(3,5-di-tert-butyl-4-hydroxy hydrocinnamate)] methane IRGANOX®-1010 represented by:

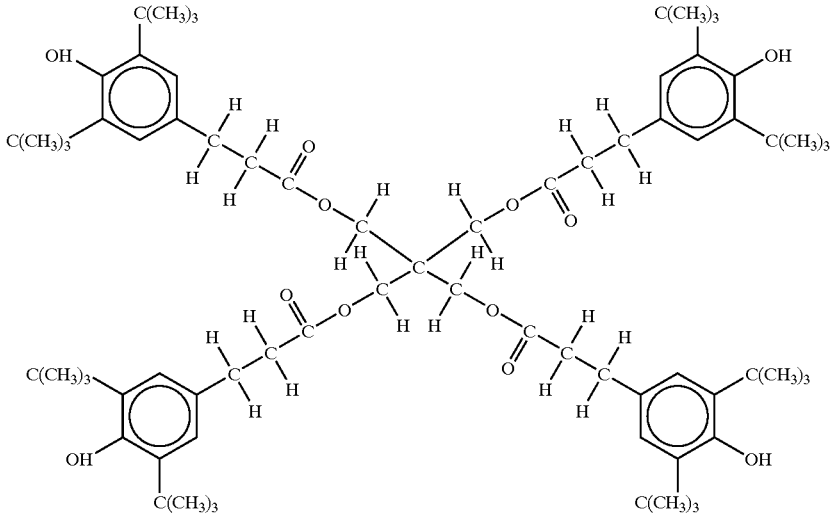

and 2,6-di-tert-butyl-4-methyl phenol (BHT) represented by:

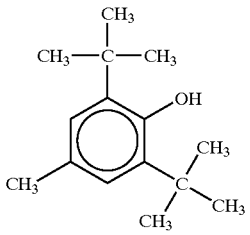

GENERAL EXAMPLE

No Hindered Phenol

An electrophotographic imaging member web stock was prepared by providing a 0.02 micrometers thick titanium layer coated on a substrate of a biaxially oriented polyethylene naphthalate substrate (KADALEX, available from ICI Americas, Inc.) having a thickness of 89 micrometers. Added to this mixture was a blocking layer solution containing 10 grams of gamma aminopropyltriethoxy silane, 10.1 grams of distilled water, 3 grams of acetic acid, 684.8 grams of 200 proof denatured alcohol and 200 grams of heptane. This layer was then allowed to dry for 5 minutes at 135 degrees Celsius in a forced air oven resulting in a crosslinked silane blocking layer. The resulting blocking layer had an average dry thickness of 0.05 micrometers as measured with an ellipsometer.

An adhesive interface layer was then deposited by applying to the blocking layer a wet coating solution containing 5 percent by weight of the polyester MOR-ESTER 49,000®, available from Morton International, and based on the total weight of the solution in a 70:30 volume ratio mixture of tetrahydrofuranicyclohexa none. The adhesive interface layer was allowed to dry for 5 minutes at 135 degrees Celsius in a forced air oven. The resulting adhesive interface layer had a dry thickness of 0.065 micrometers.

The adhesive interface layer was thereafter coated with a photogenerating layer. The photogenerating layer dispersion was prepared by adding 0.45 grams IUPILON 200®, a polycarbonate of poly(4,4'-diphenyl)-1,1'-cyclohexane carbonate (PC-z 200) available from Mitsubishi Gas Chemical Corporation and 50 milliliter of tetrahydrofuran into a 4 ounce glass bottle. 2.4 grams of hydroxygallium phthalocyanine and 300 grams of ⅛ inch (3.2 millimeters) diameter stainless steel shot were added to the solution. This mixture was then placed on a ball mill for 20 to 24 hours. Subsequently, 2.25 grams of poly(4,4'-diphenyl-1,1'-cyclohexane carbonate) having a weight average molecular weight of 20,000 (PC-z 200) was dissolved in 46.1 grams of tetrahydrofuran, then added to this hydroxygallium phthalocyanine slurry. This slurry was then placed on a shaker for 10 minutes. The resulting slurry was thereafter coated onto the adhesive interface by extrusion application process to form a layer having a wet thickness of 0.25 micrometers. This photogenerating layer comprised of poly(4,4'-diphenyl)-1,1'-cyclohexane carbonate, tetrahydrofuran and hydroxygallium phthalocyanine was dried at 135 degrees Celsius for 5 minutes in a forced air oven to form a dry thickness photogenerating layer having a thickness of 0.4 micrometers.

This coated imaging member web was overcoated with two separate charge transport layers and a ground strip layer using an extrusion co-coating process. Both charge transport layers were prepared by introducing into an amber glass N,N'-diphenyl-N,N'-bis(3-methylphenyl)-1,1'-biphenyl-4 4'-diamine hole transporting compound, represented by:

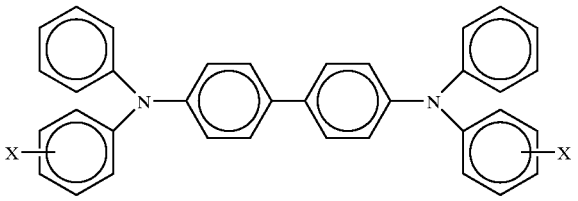

wherein X is methyl group attached to the meta position. Additionally, MAKROLON 5705®, a bisphenol A polycarbonate, poly(4,4'-isopropylidene diphenyl) carbonate, having a weight average molecular weight of about 120,000 and available from Bayer AG, was added to the charge transport layer solution. The resulting mixture was dissolved to give a solution containing 15 weight percent solids in 85 weight percent methylene chloride. This solution was applied onto the photogenerating layer to form a first charge transport layer which upon drying had a thickness of 15 micrometers. The same coating solution was then subsequently applied as a second charge transport layer and again dried to form a 14 micron thick top charge transport layer. Both the top and bottom charge transport layers comprised 50 percent by weight of the above hole transporting compound and 50 percent by weight MAKROLON® binder based on the total weight of each layer.

The approximately 10 millimeter wide strip of the adhesive layer left uncoated by the photogenerator layer was coated over with a ground strip layer during the co-coating process. This ground strip layer, after drying along with the co-coated charge transport layer at 135 degrees Celsius in a forced air oven for 5 minutes, and had a dried thickness of about 19 micrometers.

An anticurl layer coating was prepared by combining 8.82 grams of polycarbonate resin, MAKROLON 5705®, available from Bayer AG, 0.72 grams of polyester resin, VITEL PE-200, available from Goodyear Tire and Rubber Company, and 90.1 grams of methylene chloride in a glass container to form a coating solution containing 8.9 weight percent solids. The container was covered tightly and placed on a roll mill for about 24 hours until the polycarbonate and polyester were dissolved in the methylene chloride to form the anticurl coating solution. The anticurl coating solution was then applied to the rear surface (side opposite the photogenerator layer and charge transport layer) of the imaging member web stock, by extrusion coating process, and dried at 135 degrees Celsius for about 5 minutes in a forced air oven to produce a dried film thickness of about 17 micrometers.

COMPARATIVE EXAMPLE

An electrophotographic imaging member web stock was prepared using the same materials and the same process as that described in the above Example, but with the exception that the top charge transport layer also comprises 6.8 percent by weight of the antioxidant tetrakis [methylene(3,5-di-tert-butyl-4-hydroxy hydrocinnamate)]methane IRGANOX®-1010, available from Ciba Spezialitatenchemie AG. The resulting imaging member comprised a titanium substrate, a polyester adhesive layer, a hydroxygallium phthalocyanine photogenerating, layer, a dual charge transport layer as described above, a ground strip layer, and a polyester anticurl layer.

Example I

An electrophotographic imaging member web stock was prepared using the same materials and the same procedures as those described in the Comparative Example, but with the exception that the: poly(4,4'-isopropylidene)carbonate (MAKROLON®) used in the top charge transport layer was replaced with a film forming polystyrene to allow a coating solution preparation with tetrahydrofuran. The resulting imaging member comprised a titanium substrate, a polyester adhesive layer, a hydroxygallium phthalocyanine photogenerating layer, a dual charge transport layer as described above, a ground strip layer, and a polyester anticurl layer.

Example II

An electrophotographic imaging member web stock was prepared using the same materials and employed the exact same procedures as those described in Example I, with the exception that the polymer binder used in the top charge transport layer was bisphenol A polycarbonate, LEXAN 135', having a weight average molecular weight of about 47,000 and available from GE Plastics and dissolved in methylene. The resulting imaging member comprised a titanium substrate, a polyester adhesive layer, a hydroxygallium phthalocyanine photogenerating layer, a dual charge transport layer as described above, a ground strip layer, and a polyester anticurl layer.

Example III

An electrophotographic imaging member web stock was prepared using the same materials and same process as that described in Example 1, but with the exception that the polymer binder used in the second charge transport layer was an alternate polycarbonate, poly(4,4'-diphenyl)-1,1'-cyclohexane carbonate (PC-z 800), having a weight average molecular weight of about 220,000 and available from Mitsubishi Gas Chemical Corporation. The second charge transport layer solution was prepared with tetrahydrofuran or toluene or mono chloro benzene. The resulting imaging member comprised a titanium substrate, a polyester adhesive layer, a hydroxygallium phthalocyanine photogenerating layer, a dual charge transport layer as described above, a ground strip layer, and a polyester anticurl layer.

Example IV

An electrophotographic imaging member web stock was prepared using the same materials and employed the same procedures as those described in Example III, but with the exception that the second charge transport layer was comprised of 35 weight percent of a hole transport component while the hole transport component content in the first charge transport layer counterpart was 50 percent by weight. The resulting imaging member comprised a titanium substrate, a polyester adhesive layer, a hydroxygallium phthalocyanine photogenerating layer, a dual charge transport layer as described above, a ground strip layer, and a polyester anticurl layer.

Photo-Electrical and Print Testing Results

The imaging member web stocks of the Comparative Example, and Examples I to IV were evaluated for photoelectrical function and tested for print quality.

The test results obtained from the electrical scanner showed that imaging members having second and first charge transport layers prepared from the same coating solution to give identical material compositions, according to the General Example, had deletion printout defects easily detectable to the naked eye caused by lateral conductivity of the amine hole transport migrating to the photogenerating layer, while the imaging members, prepared with IRGANOX® antioxidant in the second charge transport layer, were free of copy deletion printout defects.

Although incorporation of IRGANOX®-1010 in second charge transport layer was effective in substantially resolving the lateral charge migration problem, the imaging member of the Comparative Example exhibited a residual potential increase of about 20 volts at time zero and 35 volts after 10,000 cycles. The photo-electrical performance of the resulting imaging member results from the dissolution of first charge transport layer by methylene chloride upon application of top charge transport layer and IRGANOX®-1010 migration into the photogenerating layer.

Although the invention has been described with reference to specific embodiments, it is not intended to be limited thereto. Rather, those having ordinary skill in the art will recognize that variations and modifications, including equivalents, substantial equivalents, similar equivalents, and the like may be made therein which are within the spirit of the invention and within the scope of the claims.

What is claimed is:

1. An imaging member comprising:

a photogenerating layer;

(1) a first charge transport layer formed from a mixture comprising a charge transport component and a resin binder; and thereover and in contact with the first layer (2) a second charge transport layer formed from a mixture comprising N,N'-diphenyl-N,N'-bis(alkylphenyl)-1,1-biphenyl-4,4'-diamine, a resin binder and a hindered phenol comprising tetrakis [methylene(3,5-di-tert-butyl-4-hydroxy hydrocinnamate)]methane or 2,6-di-tert-butyl-4-methylphenol dissolved in a solvent comprised of tetrahydrofuran and toluene, wherein said second charge transport layer binder comprises a polyphthalate represented by:

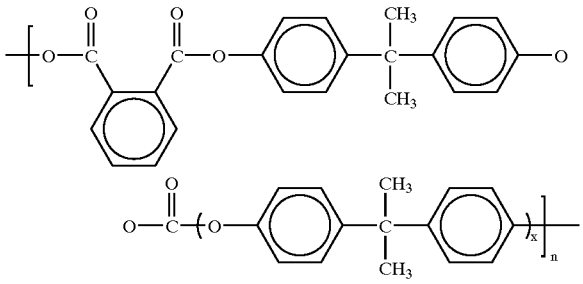

where x represents the number of segments, and n is the degree of polymerization.

2. An imaging member according to claim 1 wherein said first charge transport layer binder comprises a polycarbonate.

3. An imaging member according to claim 1 wherein the first charge transport layer mixture comprises a binder comprising poly(4,4'-isopropylidene phenyl)carbonate dissolved in methylene chloride.

4. An imaging member according to claim 1 wherein said second charge transport layer binder is present in an amount of from about 40 to about 60 weight percent based on the total weight of the second charge transport layer.

5. An imaging member according to claim 1 wherein said first charge transport layer has a thickness of from about 10 micrometers to about 20 micrometers.

6. An imaging member according to claim 1 wherein said second charge transport layer has a thickness of from about 10 micrometers to about 20 micrometers.

7. An imaging member according to claim 1, wherein said first charge transport layer contains an arylamine represented by:

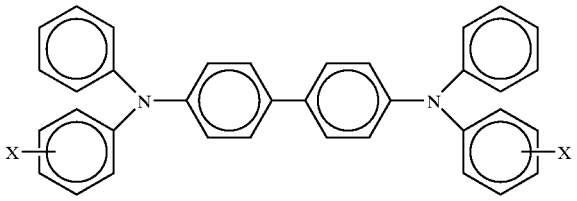

wherein X is selected from the group consisting of alkyl and halogen.

8. An imaging member according to claim 1, wherein said first charge transport layer contains an arylamine selected from the group consisting of, N,N'-diphenyl-N,N'-bis(alkylphenyl)-1,1-biphenyl-4,4'-diamine, N,N'-diphenyl-N,N'-bis(halophenyl)-1,1'-biphenyl-4,4'-diamine, tritolylamine, N,N'-bis(3,4 dimethylphenyl)-N',N-'(1-biphenyl)amine, 2-bis((4'-methylphenyl)amino-p-phenyl) 1,1-diphenyl ethylene, and 1-bisphenyl-diphenylamino-1-propene.

9. An imaging member according to claim 1 wherein said hindered phenol is present in the second charge transport layer in an amount of from about 3 to about 20 percent by weight based on the total weight of the second charge transport layer.

10. An imaging member according to claim 1 wherein said hindered phenol is present in the second charge transport layer in an amount of from about 5 to about 10 percent by weight based on the total weight of the second charge transport layer.

11. An imaging member according to claim 1 wherein said first charge transport layer is formed from the mixture dissolved in methylene chloride.

12. An imaging member according to claim 1 wherein each of said first and second charge transport layer comprises said binder in an amount of from about 20 to about 80 percent by weight.

13. The imaging member according to claim 12 wherein the imaging member is in the form of a belt.

14. The imaging member according to claim 12 wherein the imaging member is in the form of a drum.

15. The imaging member according to claim 12 and further comprising a blocking layer, an adhesive layer, and an overcoat layer.

16. An imaging member according to claim 1 wherein each of said first and second charge transport layers comprise a charge transport component in an amount of from about 20 to about 80 percent by weight.

17. An imaging member according to claim 1 further comprising an adhesive layer and an overcoat layer.

18. An imaging member according to claim 1 wherein said member further comprises a substrate having a thickness of from about 50 micrometers to about 1,000 micrometers.

19. An imaging member according to claim 1 wherein said member further comprises a substrate having a thickness of from about 50 micrometers to about 10 micrometers.

20. An imaging member according to claim 1 wherein said member further includes a charge blocking layer comprising epoxy resins, polyesters, polysiloxanes, polyamides, polyurethanes, polyphosphazines, polyvinyl butyral, and phenolic resins.

21. An imaging member according to claim 1 wherein said member further includes a blocking layer having a thickness of from about 0.05 micrometers to about 4 micrometers.

22. An imaging member according to claim 1 wherein said first and second charge transport layers are applied in at least two separate passes.

23. An imaging member according to claim 1 wherein said photogenerating layer comprises Type V hydroxygallium phthalocyanine, chlorogallium phthalocyanine, x-polymorph metal-free phthalocyanine, vinyl chloride, or trifluoroacetic acid dispersed in an arylamine hole transport matrix.

24. An imaging member according to claim 1 wherein said photogenerating layer comprises hydroxygallium phthalocyanine.

25. An imaging member according to claim 1 wherein said photogenerating layer has a thickness of from about 0.05 micrometers to about 40 micrometers.

26. An imaging member according to claim 1 wherein each of said charge transport layers has a thickness of from about 10 to about 20 micrometers.

27. An imaging member according to claim 1 wherein said photogenerating layer further comprises a binder selected from the group consisting of polycarbonates, polyesters, including polyethylene terephthalate, polyurethanes, polystyrenes, polybutadienes, polysulfones, polyarylethers, polyarylsulfones, polyethersulfones, polycarbonates, polyethylenes, polypropylenes, polymethylpentenes, polyphenylene sulfides, polyvinyl acetates, polyvinylbutyrals, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchlorides, polyvinyl alcohols, poly-N-vinylpyrrolidinones, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, and polyvinylcarbazoles.

28. An image forming device comprising at least a photoreceptor, a developer for developing an image, and a charging device which charges the photoreceptor, wherein the photoreceptor comprises:

a photogenerating layer;

(1) a first charge transport layer formed from a mixture comprising a charge transport component and a resin binder; and thereover and in contact with the charge transport layer, (2) a second charge transport layer formed from a mixture comprising N,N'-diphenyl-N,N'-bis(alkylphenyl)-1,1-biphenyl-4,4'-diamine, a resin binder and a hindered phenol comprising tetrakis [methylene(3,5-di-tert-butyl-4-hydroxy hydrocinnamate)]methane or 2,6-di-tert-butyl-4-methylphenol dissolved in a solvent comprised of tetrahydrofuran and toluene, wherein said second charge transport layer binder comprises a polyphthalate represented by:

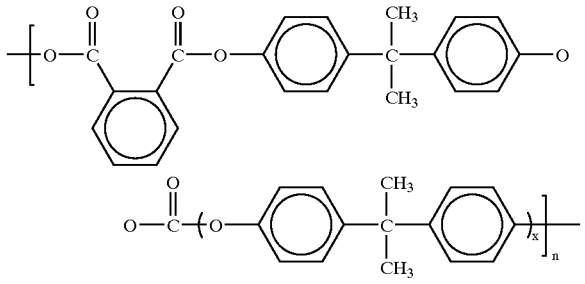

where x represents the number of segments, and n is the degree of polymerization.

* * * * *